US006993254B2

(12) United States Patent
Bosworth

(10) Patent No.: US 6,993,254 B2
(45) Date of Patent: Jan. 31, 2006

(54) MANIFOLD AND HEATER

(75) Inventor: Jeremy Damien Bosworth, Birmingham (GB)

(73) Assignee: Heating World Group Limited, Birmingham (GB)

( * ) Notice: Subject to any disclaimer, the term of this patent is extended or adjusted under 35 U.S.C. 154(b) by 0 days.

(21) Appl. No.: 10/852,498

(22) Filed: May 24, 2004

(65) Prior Publication Data

US 2004/0234256 A1 Nov. 25, 2004

(30) Foreign Application Priority Data

May 24, 2003 (GB) ..... 0312004

(51) Int. Cl.
*F24H 1/20* (2006.01)

(52) U.S. Cl. ..... 392/452; 392/462; 122/510

(58) Field of Classification Search ..... 392/465–492
See application file for complete search history.

(56) References Cited

U.S. PATENT DOCUMENTS 1,985,830 A * 12/1934 Hynes ..... 392/492
5,548,100 A * 8/1996 Miller ..... 219/521

FOREIGN PATENT DOCUMENTS

| | | |
|---|---|---|
| BE | 10070008 | 2/1995 |
| EP | 0928939 | 6/2000 |
| GB | 2292074 | 2/1996 |

* cited by examiner

*Primary Examiner*—Thor S. Campbell
(74) *Attorney, Agent, or Firm*—Andrus, Sceales, Starke & Sawall, LLP

(57) ABSTRACT

A manifold for supplying hot water to a heater such as a towel holder has a tubular outer body for mounting in a generally vertical disposition. The upper end of the outer body is closed off and an inner tube is mounted within the outer body, to communicate therewith at or adjacent the upper end. First and second connectors for first and second external pipes leading to the heater communicate with the interior of the outer body. An electrically-powered immersion heater is disposed within the inner tube and when energised raises the temperature of water in the inner tube thereby promoting convection circulation of hot water through a heater connected to the manifold by the first and second external pipes.

3 Claims, 4 Drawing Sheets

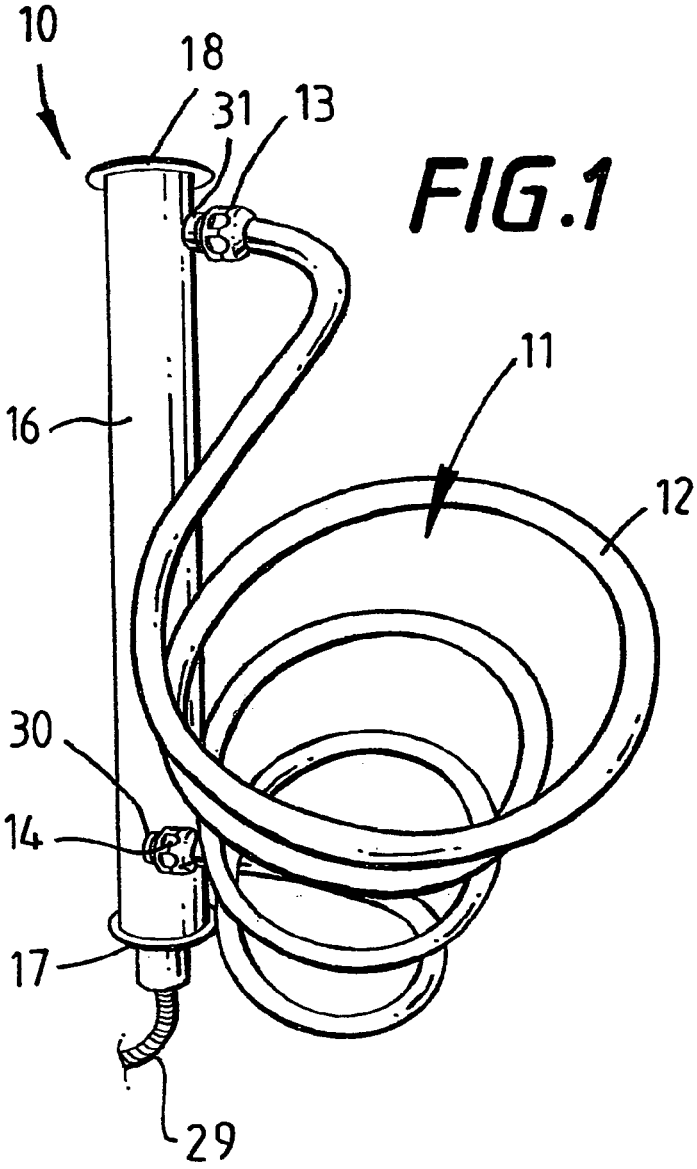
FIG.1
FIG.3A
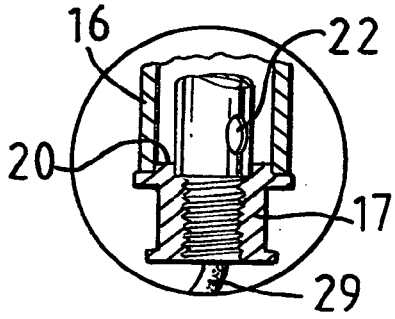
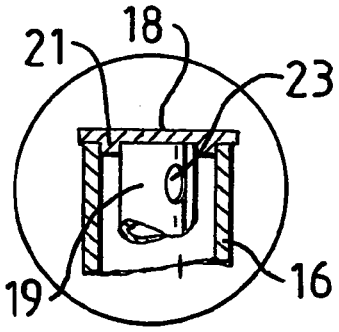
FIG.3B

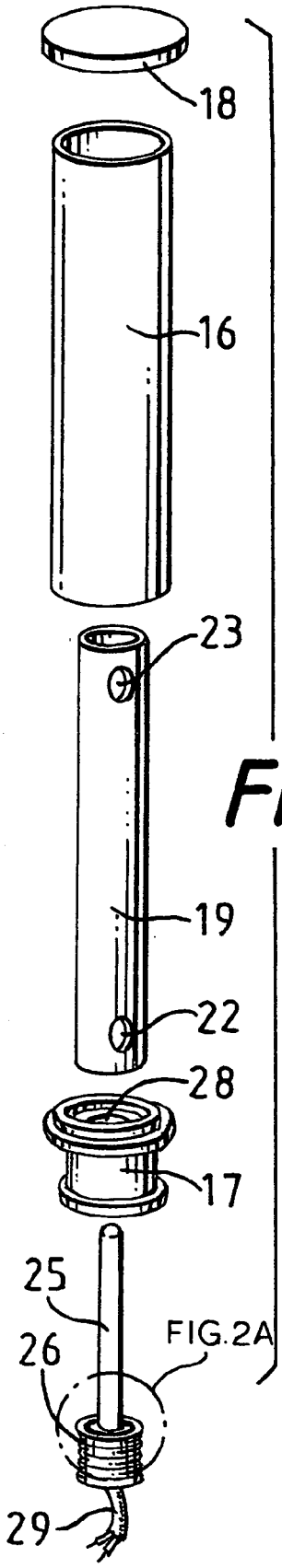
FIG. 2
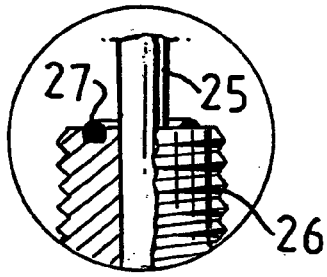
FIG. 2A
FIG. 3
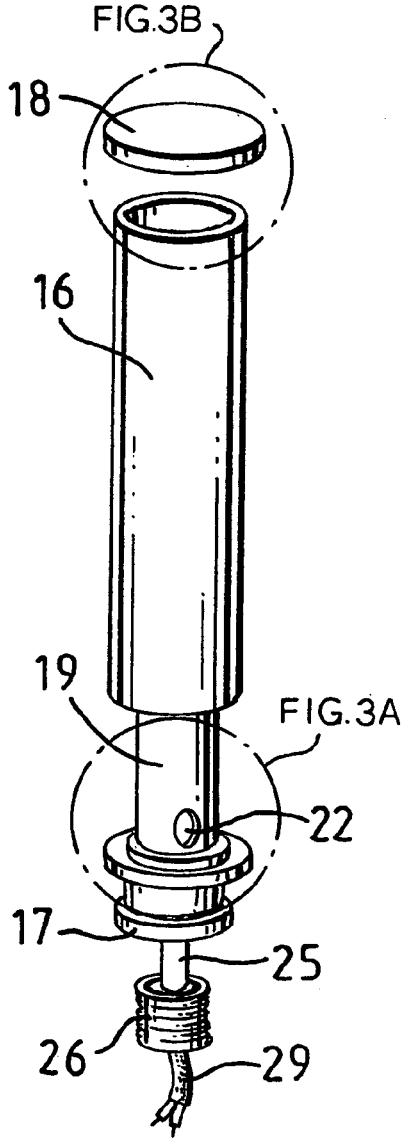

MANIFOLD AND HEATER

CROSS-REFERENCE TO RELATED APPLICATIONS

This application claims priority to Great Britain Patent Application No. 0312004.5, filed May 24, 2003.

BACKGROUND OF THE INVENTION a) Field of the Invention

This invention relates to a water manifold for the connection of a heater thereto, as well as to the combination of such a water manifold and a heater.

Though this invention relates both to a water manifold and a heater which may be connected to the manifold, in general terms (but not exclusively) the invention concerns the provision of a heated towel rail or holder, for example for use in a domestic bathroom. As such, the invention will hereinafter be described mainly with reference to heated towel rails or holders, though it will be understood that the invention may find uses elsewhere. Further, the terms towel rail and towel holder are used more or less interchangeably, as the context requires, to refer to apparatus for the temporary storage of a towel within a domestic environment, between uses of the towel.

b) Description of the Related Art

Traditionally, a heated towel rail for a bathroom has a pair of upright tubes connected to a domestic hot-water heating system, there being at least one but usually two or more horizontal tubes extending between the upright tubes and through which heated water flows, so that towels hung on the horizontal tubes will be heated and dried. Increasingly, there are calls for more aesthetically-pleasing equipment for use in a domestic environment and as such, towel rails of more attractive designs have been proposed. However, many of these may be difficult to connect to a domestic hot-water heating system, or cannot be used if there is no such heating system.

Bearing in mind the above, one of the aims of the present invention is to provide a water manifold which may be used for the connection of a heater such as a heated towel rail thereto.

BRIEF SUMMARY OF THE INVENTION

According to a first aspect this invention, there is provided a manifold for supplying hot water to a heater, said manifold comprising a tubular outer body adapted to be mounted in a generally vertical disposition, the upper end of the body being closed off, and an inner tube mounted within the outer body and communicating with the outer body at or adjacent its upper end. A first connector for a first external pipe leading to the heater communicates with the interior of the outer body adjacent the upper end thereof, and a second connector for a second external pipe also leading to the heater communicates with the interior of the outer tube adjacent the lower end thereof. An electrically-powered immersion heater within the inner tube is arranged when energised to raise the temperature of water in the inner tube thereby in use promoting convection circulation of hot water through a heater connected to the manifold by means of the first and second external pipes.

With the manifold of this invention, it becomes possible to provide a fully self-contained heater, powered by electricity. The manifold may supply hot water to a heater such as a towel rail or holder, without the need to provide two separate pipes in the immediate vicinity of the towel rail or holder. The manifold thus permits the connection of the heater in an aesthetically pleasing manner and so particularly lends itself to use in a bathroom or other open space where the pipework might otherwise be exposed. Further, the arrangement of manifold permits the establishment of a convection heating circuit when a towel rail or holder is connected to the manifold, whereby the hot water will flow through that towel rail or holder.

This invention also extends to a manifold as described above, in combination with a heater such as a towel rail or towel holder connected to the first and second connectors of the outer body.

BRIEF DESCRIPTION OF THE DRAWINGS

Several specific embodiments of this invention will now be described in detail, though only by way of example, reference being made to the accompanying drawings. In the drawings:

FIG. 1 is a diagrammatic sketch showing a first embodiment of manifold of this invention in combination with a towel holder;

FIG. 2 is an exploded view of the first embodiment of manifold, shown in FIG. 1, FIG. 2A being a detail view on an enlarged scale of the lower part of the heating element shown in FIG. 2;

FIG. 3 is similar to FIG. 2 but with the components partly assembled and FIGS. 3A and 3B are detail views on the lower and upper parts of the manifold;

DETAILED DESCRIPTION OF THE INVENTION

Figure 4:
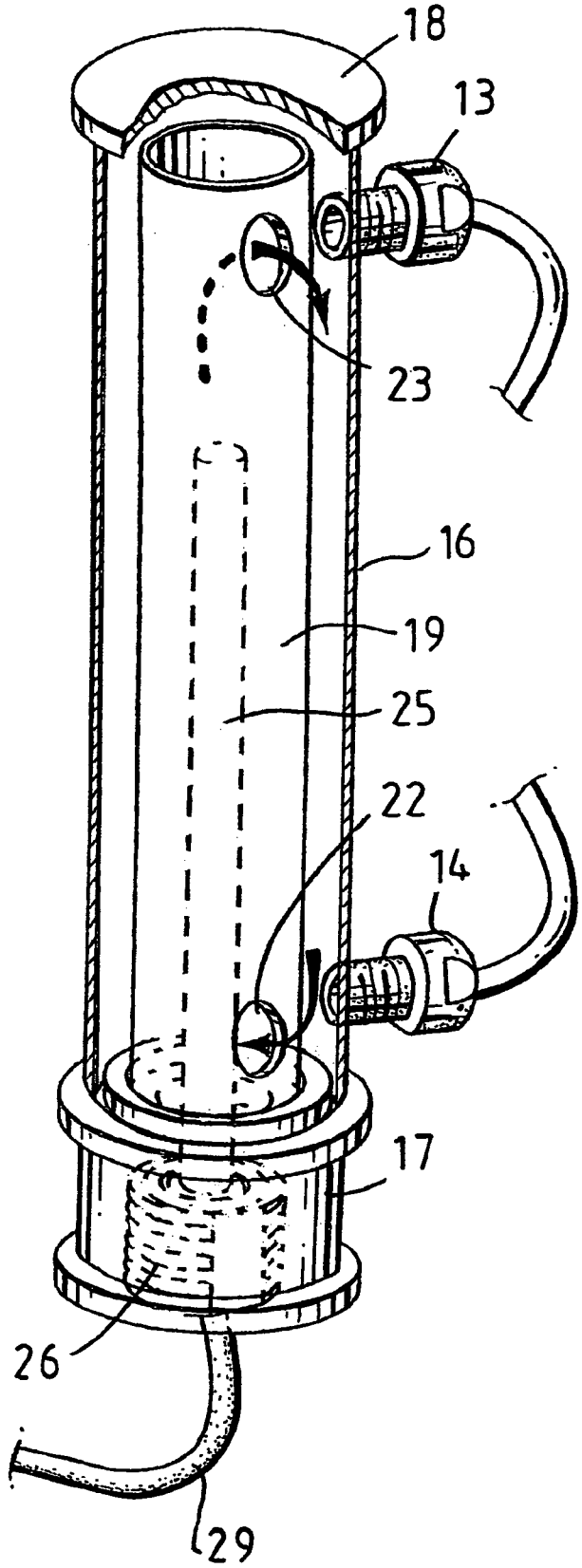
FIG. 4 illustrates the water flow path through the manifold shown in FIGS. 1 to 3.

The immersion heater provided within the manifold inner tube preferably includes an elongate rod-like element which extends at least partway along the length of the inner tube. Such a heater should also have a thermostatic control arrangement as well as conventional safety features associated with immersion heaters. In a preferred construction, the lower end of the outer body is provided with a closure through which the immersion heater passes in a sealing manner, so enabling electrical connections to be made externally of the manifold.

Preferably, the heater associated with the manifold is in the form of a heated towel rail or holder and in that case, it is advantageous for the towel rail or holder to be connected directly to the first and second connectors of the manifold outer body, the towel rail or holder providing the first and second pipes. In a preferred combination of this invention, the towel rail or holder is in the form of a continuous tube the two ends of which are connected respectively to the first and second connectors of the tubular body. In this case, the continuous tube may be formed generally to be a conical helix with the lower end of the helix lowermost whereby at least a part of a towel may be dropped into the conical volume bound by the helix so as to remain therein. Upon establishment of flow of hot water through the tube, the towel will be heated thereby.

The manifold of this invention may support a plurality of towel rails or holders each of a generally similar or identical form and spaced along the length of the manifold. To permit this, the manifold may be generally elongate and could either be secured to a wall or upstand from a floor fitting. Further, in addition to being spaced along the length of the manifold, the plurality of towel rails or holders may also be spaced in the circumferential direction, around the manifold. In a simpler version, there may be just two or three such towel rails or holders, spaced circumferentially but at more or less the same axial position along the manifold.

Preferred embodiments of the invention will now be described in detail, referring to the drawings as necessary.

Referring initially to FIG. 1, there is shown in combination a first embodiment of manifold 10 of this invention together with a heated towel holder 11. The towel holder 11 comprises a single continuous tube 12 provided with compression fittings 13,14 at its two ends. The tube is formed to have a generally conical helical shape such that the effective diameter of that shape changes along the axis of the shape. Thus, the tube 12 defines an open conical basket and is dimensioned so as to be suitable for holding at least the greater part of a typical domestic bath towel. However, the tube could be dimensioned differently, for example to hold the greater part of a hand towel.

The towel holder should be aesthetically pleasing, since it will, when installed in a domestic bathroom, be quite noticeable. Thus, the tube typically will be of copper, brass or other ductile material which can be formed into the required shape and is given an attractive non-corroding finish—for example of chromium plating. Alternatively, the tube 12 could be of polished or satin—finished stainless steel. Further, the nuts of the compression fittings advantageously are of a more attractive appearance than a simple hexagonal nut and also are finished in a pleasing manner—again, either by polishing if of stainless steel or plating if of other materials.

The towel holder 11 is attached to the manifold 10 solely by its compression fittings 13,14 at the two ends of the tube 12. Thus, the tube should have sufficient strength to withstand all normal usage without significant deflection from the intended shape. Further, when mounted on the manifold with the compression fitting 13 vertically above fitting 14, the axis of the conical shape of the holder 11 preferably is out of vertical, and also leaning away from the manifold, all as shown in FIG. 1.

Referring now particularly to FIGS. 2 to 4, there is shown the details of the first embodiment of manifold. This comprises an outer body 16 provided at its lower end with a closure 17 and at its upper end a cap 18. Located concentrically within the outer body is an inner tube 19 which locates against flanges 20,21 provided respectively on the closure 17 and the cap 18. The closure and end cap are secured to the main body by a brazing or soldering operation. The inner tube is of an appropriate length to extend between the closure and end cap but does not need to be secured in position since it is located by the flanges 20,21. The inner tube has lower and upper transverse openings 22,23 permitting the free flow of water into and out of the inner tube.

The closure 17 has a threaded bore in which is furnished an elongate rod-like electrical immersion heater 25, the lower end of the heater having a threaded boss 26 which engages the threads of the closure 17. An O-ring seal 27 is provided on the inner end of the boss 26 and seals against a shoulder 28 provided at the upper end of the threads in the closure 17. An electrical cable 29 leads away from the boss 26, to permit the supply of power to the immersion heater. The heater must have a fail-safe thermostat system, to limit the upper temperature of the water in the manifold and also to cut off the supply of electricity in the event of a fault.

Lower and upper threaded fittings 30,31 are secured to the outer body, typically by a brazing operation. The fittings are externally screw-threaded and co-operable with the compression fittings 13,14 of the towel holder 11. A suitable clamp arrangement is provided (not shown) to secure the manifold to a wall, in the region where the towel holder is to be furnished.

In use, the system of FIGS. 1 to 3 is filled with water but in such a way as to leave a pocket of air trapped below the end cap 18, to serve as an expansion chamber as the water is heated. Conveniently, this may be achieved by inverting the system before installation, removing the immersion heater and then filling the manifold with water to the required level, before refitting the immersion heater. An anti-corrosion agent may be added to the water used to fill the heater. Once filled and suitably mounted mechanically, the cable 29 is connected to a suitable electrical supply with an isolator switch, possibly also provided with a time switch. When energised, the heater 25 will raise the temperature of water within the inner tube 19, so promoting a convection flow as shown by the arrows in FIG. 14. Though there will be some flow in the annular space between the inner tube 19 and the outer body 16, some of the flow will also pass through the tube 12. A towel may be temporarily stored on the holder 11 merely by being tossed into the basket-like shape defined by the tube 12. So long as sufficient of the towel is in the shape, it will remain there and will be heated by the water passing through the tube 12.

The embodiment of manifold described above may be extended so as to have a much greater length than that shown in the drawings. Then, the manifold may support a plurality of the towel holders, disposed generally one above the other though not necessarily in the same axial line.

Figure 5A:
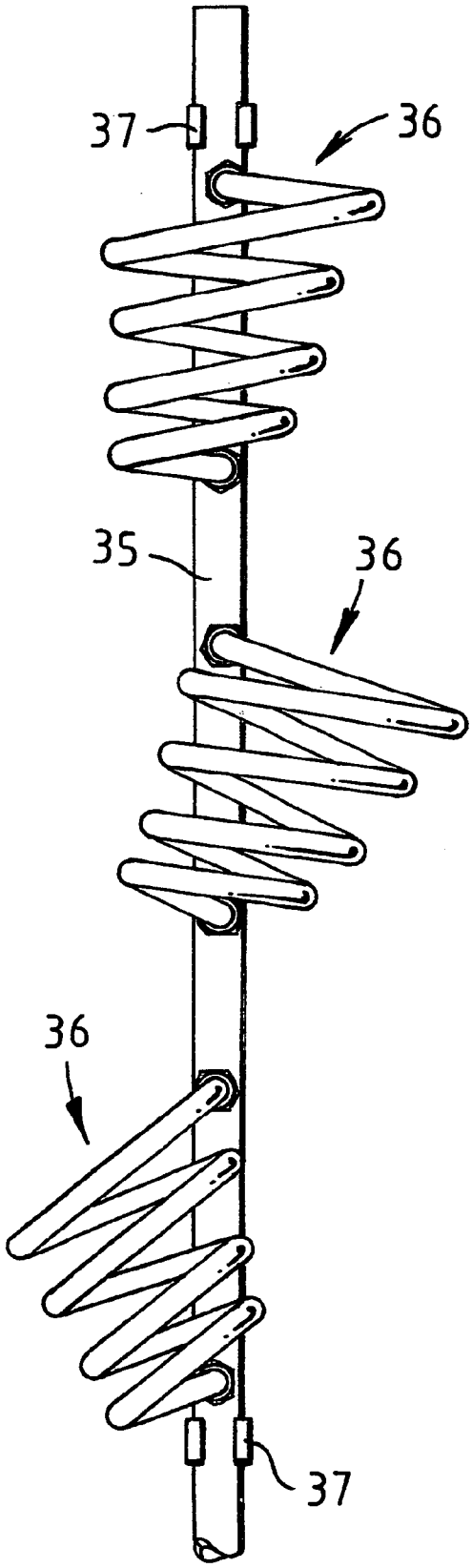
FIGS. 5A and 5B diagrammatically show a manifold of this invention, used to support four towel holders of this invention.
Figure 5B:
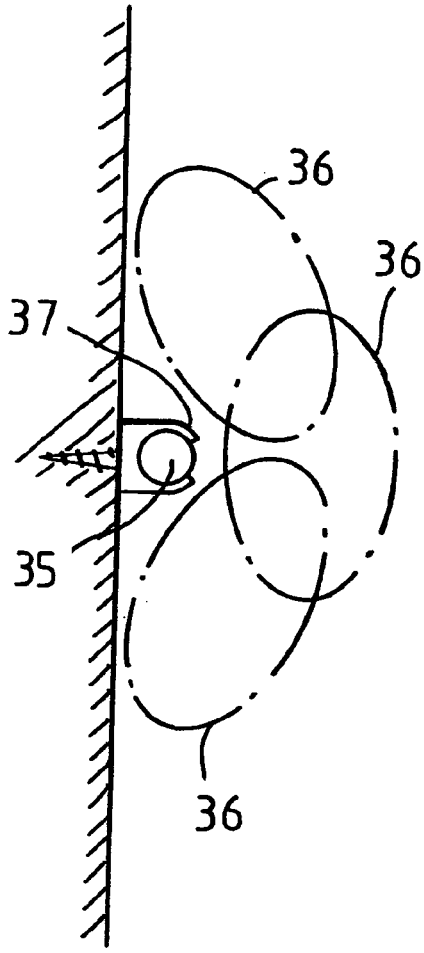

FIGS. 5A and 5B show a possible configuration for a manifold 35 having a sufficient length to support a plurality of separate towel holders 36. Each of the holders 36 is similar to that shown in FIG. 1, the holders being spaced along the manifold but also being displaced about the axis of the manifold as shown in FIG. 5B, to give easier access to the upper mouth of each holder.

Rather than have the manifold 35 secured to a wall, for example by means of a clamp arrangement 37 interfitting therewith, the unit could be arranged as a floor-standing holder, especially where more than one towel holder 36 is provided. In this case, the manifold 35 may be provided with a base screwed to the floor.

I claim:

1. In combination (a) a manifold for supplying hot water to a heater, comprising:

a tubular outer body adapted to be mounted in a generally vertical disposition, the upper end of the body being closed off;

an inner tube mounted within the outer body and communicating with the outer body at or adjacent its upper end;

a first connector for a first external pipe leading to the heater, which first connector communicates with the interior of the outer body adjacent the upper end thereof;

a second connector for a second external pipe also leading to the heater, which second connector communicates with the interior of the outer body adjacent the lower end thereof; and an electrically-powered immersion heater within the inner tube arranged when energized to raise the temperature of water in the inner tube thereby in use promoting convection circulation of hot water through a heater connected to the manifold by means of the first and second external pipes; and (b) a heater connected to the first and second connectors of the outer body, wherein the heater is in the form of a heated towel rail or towel holder, wherein the heated towel rail or towel holder is connected directly to the first and second connectors of the manifold outer body, the towel rail or towel holder providing said first and second pipes connected respectively to the first and second connectors of the tubular body, wherein the towel rail or towel holder is in the form of a continuous tube the two ends of which are connected respectively to the first and second connectors of the tubular body, and, wherein the continuous tube is formed into the general shape of a conical helix with the smaller end of the helix lowermost, whereby at least part of a towel may be dropped into the shape bound by the conical helix so as to remain therein, the towel then being heated by fluid flowing through the formed tube.

2. The combination as claimed in claim 1, wherein the axis of the conical helix is inclined at an angle to the vertical.

3. The combination of claim 1, wherein the conical helix is of irregular form.

* * * * *